US008075458B2

(12) United States Patent
Nalley

(10) Patent No.: US 8,075,458 B2
(45) Date of Patent: Dec. 13, 2011

(54) WEIGHT PLATE LOCKING AND LIFTING SYSTEM

(76) Inventor: Mark Nalley, Murrieta, CA (US)

( * ) Notice: Subject to any disclaimer, the term of this patent is extended or adjusted under 35 U.S.C. 154(b) by 0 days.

(21) Appl. No.: 12/798,239

(22) Filed: Apr. 1, 2010

(65) Prior Publication Data

US 2011/0245048 A1 Oct. 6, 2011

(51) Int. Cl.
*A63B 21/062* (2006.01)
*A63B 21/06* (2006.01)

(52) U.S. Cl. ..... 482/98; 482/94

(58) Field of Classification Search ..... 482/92–94, 482/97–109; *A63B 21/06, 21/062*
See application file for complete search history.

(56) References Cited

U.S. PATENT DOCUMENTS

| | | | | |
|---|---|---|---|---|
| D441,813 | S * | 5/2001 | Ceppo | D21/686 |
| 6,682,464 | B2 * | 1/2004 | Shifferaw | 482/106 |
| D519,173 | S * | 4/2006 | Nalley | D21/680 |
| 7,172,536 | B2 * | 2/2007 | Liu | 482/108 |
| 7,179,208 | B1 * | 2/2007 | Nalley | 482/99 |
| 7,435,206 | B1 * | 10/2008 | Nalley | 482/106 |
| 7,608,021 | B1 * | 10/2009 | Nalley | 482/98 |
| 2007/0243976 | A1 * | 10/2007 | Cao | 482/94 |
| 2009/0048079 | A1 * | 2/2009 | Nalley | 482/107 |
| 2010/0009819 | A1 * | 1/2010 | Nalley | 482/98 |

* cited by examiner

*Primary Examiner* — Stephen Crow
*Assistant Examiner* — Oren Ginsberg
(74) *Attorney, Agent, or Firm* — Moreland C. Fischer

(57) ABSTRACT

Weight plate locking and lifting systems by which one or more weight plates are detachably connected to a lifting handle bar to enable the weight plates to be removed from or returned to a nearby storage rack without having to lift, transport and handle the weight plates. Each weight plate includes a toggle lever switch arm that is coupled to a locking pin. Each weight plate also includes a radially-extending locking cavity within which to removably receive the lifting handle bar. When the toggle lever switch arm is moved to a locked position, the locking pin slides in a first direction through the weight plate and into engagement with the lifting handle bar within the locking cavity. When the toggle lever switch arm is moved to an unlocked position, the locking pin slides in an opposite direction out of engagement with the lifting handle bar.

21 Claims, 9 Drawing Sheets

WEIGHT PLATE LOCKING AND LIFTING SYSTEM

BACKGROUND OF THE INVENTION

1. Field of the Invention

This invention relates to a weight plate locking and lifting system to be used during body building exercises wherein a number of weight plates can be selectively engaged and lifted upwardly from a storage tray or disengaged and returned to the tray. Each weight plate includes a mechanical switch-controlled locking pin that is slidable through the weight plate by which to cause the plate to be either attached to or detached from a weight lifting post of the locking and lifting system.

2. Background Art

Weight lifting apparatus is known by which a number of weights (e.g., weight plates) are lifted during a body building exercise in response to a pushing or pulling force applied by the user to a lifting handle bar or the like. The number of weights lifted will depend upon the exercise objectives of the user. In some cases, the user must remove each weight from a remote storage location to be carried to and attached to the apparatus. Consequently a weight might be dropped during handling and attachment. The user may also experience difficulty while attaching and/or removing the weight to or from the apparatus. It would therefore be desirable to avoid the transport and handling of the weights to be removed from their remote storage location when not in use and attached to the weight lifting apparatus to begin an exercise. It would also be desirable to facilitate the attachment of the weight to and removal of the weight from the apparatus.

SUMMARY OF THE INVENTION

In general terms, weight plate locking and lifting systems are disclosed which include a nearby storage rack in which weight plates are seated when not in use and from which the weight plates are removed following their attachment to a lifting post of the system during a body building exercise. Thus, one or more weight plates may be engaged and removed from the rack by the lifting post without the user having to lift, handle and transport the plates.

According to one preferred embodiment, each weight plate preferably has a disk-like body with a locking cartridge cavity located at one side thereof. A lifting post cavity extends radially through the plate body from the top thereof. A locking channel runs through the plate body between the locking cartridge cavity and the lifting post cavity. A locking cartridge is located within the locking cartridge cavity of each weight plate that is seated in the storage rack. The locking cartridge enables the weight plate to be selectively coupled to the lifting post so as to be lifted from (or returned to) the rack. The lifting post is moved downwardly through the lifting post cavity at which to engage the weight plate. The lifting post is carried by a handle bar of the system to which a lifting force is applied by the user so that weight plates attached to the lifting post are moved upwardly and out of the storage rack.

The locking cartridge includes a sliding locking pin that moves reciprocally through the weight plate body into and out of engagement with the lifting post via one of a series of coupling holes formed therein. The movement of the sliding locking pin is controlled by a switch knob that is rotated between unlocked and locked positions. The switch knob is interconnected with the sliding locking pin by means of a rotatable toggle lever switch arm within the locking cartridge. A rotational force applied to the switch knob by the user is translated by the toggle lever switch arm into a linear displacement of the locking pin through the locking channel of the weight plate. When the switch knob is rotated to a locked position, the rotatable toggle lever switch arm is correspondingly rotated in a first direction so that the sliding locking pin is pushed outwardly of the locking cartridge and through the locking channel in the weight plate to be received through a coupling hole of the lifting post by which the weight plate is coupled to the lifting post to be lifted out of the storage rack. When the switch knob is rotated to an unlocked position, the rotatable toggle lever switch arm is correspondingly rotated in an opposite direction so that the sliding locking pin is pulled through the locking channel and inwardly of the locking cartridge to be removed from the coupling hole of the lifting post by which the weight plate is detached from the lifting post to be returned to the storage rack.

In another preferred embodiment, one or more weight plates are detachably connected to the handle bar of a dumbbell when a mechanical switch-controlled locking pin slides over the top of and into engagement with the handle bar that is removably received within a lifting bar cavity formed in each of the weight plates to be lifted.

DESCRIPTION OF THE PREFERRED EMBODIMENT

Figure 1:
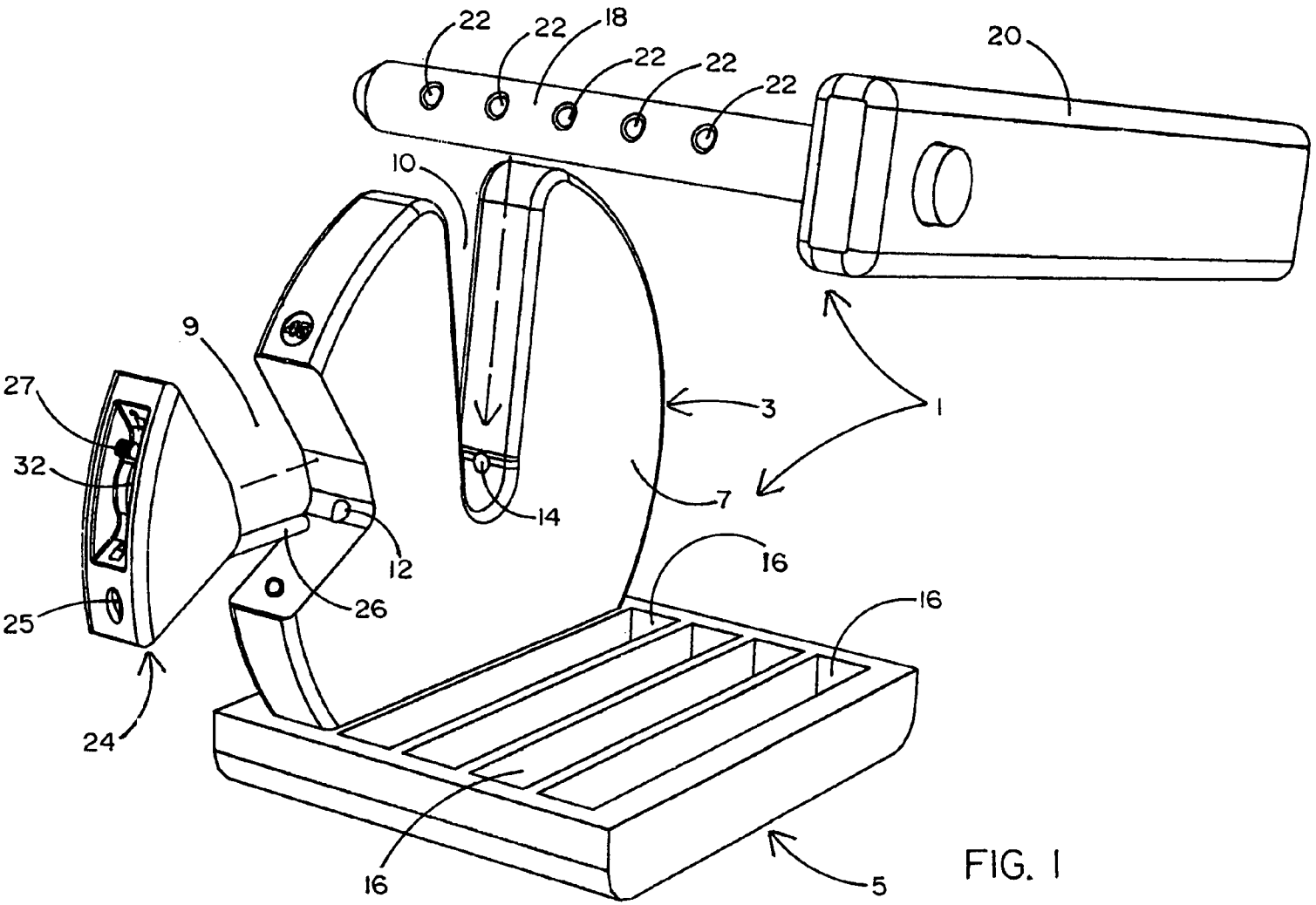
FIGS. 1 and 2 are exploded views of a weight plate locking and lifting system according to a preferred embodiment of this invention by which one or more weight plates are lifted outwardly from or returned to a storage rack.
Figure 2:
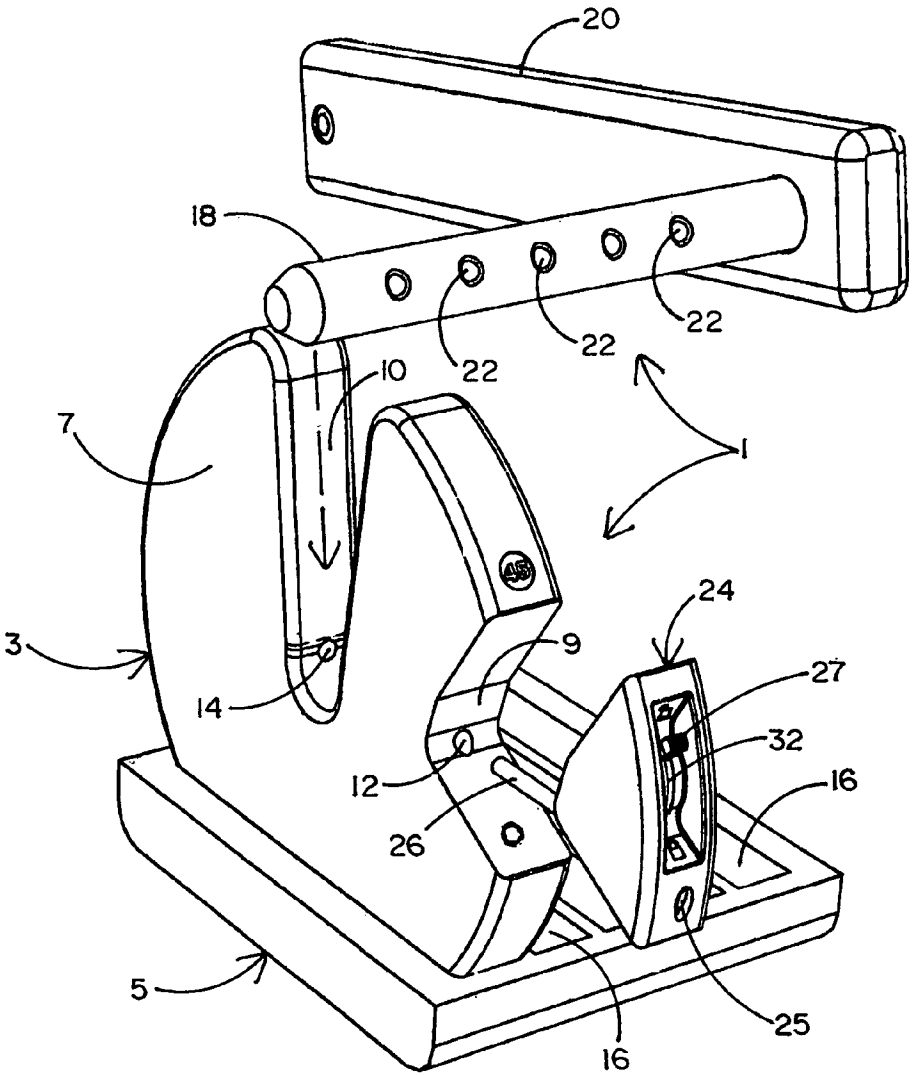

A weight plate locking and lifting system 1 according to a preferred embodiment of this invention is initially described while referring concurrently to FIGS. 1-4 of the drawings. As will be disclosed in greater detail hereinafter, the system 1 enables a desired number of individual weight plates 3 that are seated in a nearby storage rack 5 to be engaged and lifted independently of other weight plates that are left behind in the rack 5. By virtue of the foregoing, an individual wishing to lift weights during a physical fitness body building program may selectively lift a particular number of weight plates 3 corresponding to a cumulative weight without having to first remove, handle, and carry any of the weight plates 3 from a remote storage location at which they are often stored to be coupled to weight lifting apparatus.

Each weight plate 3 preferably includes a disk-like body 7 that is, for example, manufactured from iron, steel, urethane, rubber, plastic or a composite material. The weight of each weight plate 3 can vary with the requirements of the weight lifting exercise. A locking cartridge cavity 9 is located at one side of the body 7 of weight plate 3. A radially extending lifting post cavity 10 is formed through the body 7 from the top edge thereof. A locking channel 12 runs through the body 7 between the locking cartridge cavity 9 and the lifting post cavity 10. A locking channel extension 14 is formed in the body 7 opposite the locking channel 12. The locking channel 12 and locking channel extension 14 are axially aligned with and separated from one another by the lifting post cavity 10.

The weight plate storage rack 5 has a plurality of rectangular slots 16 extending therethrough. The slots 16 are sized to accommodate therewithin respective ones of the weight plates 3. During the weight lifting exercise, any desired number of the weight plates 3 seated within the slots 16 are lifted upwardly from and out of the rack 5. At the conclusion of the weight lifting exercise, the weight plates 3 are simply lowered towards and returned directly to the rack 5. However, as earlier indicated, the weight plates 3 need not be individually handled and carried to or from the rack 5 by the user at the beginning or end of an exercise. Thus, when they are not in use, the weight plates 3 may at all times remain seated and readily accessible within the slots 16 of the rack 5.

To this end, the storage rack 5 is ideally located adjacent the weight lifting apparatus to which the weight plates 3 are to be coupled. In the example of FIG. 1, the weight lifting apparatus of the weight plate locking and lifting system 1 includes a weight plate lifting post 18 that is carried by and extends from a lifting handle bar 20. A series of coupling holes 22 are formed in spaced axial alignment through the lifting post 18. The weight lifting apparatus shown in FIG. 1 may have a pair of such lifting handle bars 20 and lifting posts 18 that are separated from one another to be coupled to the weight plates 3 that are seated within a corresponding pair of racks 5 (only one of which being shown). During an exercise, a lifting force applied to the pair of handle bars 20 by the hands of the user is transferred to the lifting posts 18 to cause a desired numbers of weight plates 5 to be lifted upwardly and outwardly from their respective racks 5 in a manner that will soon be explained. For the purpose of convenience, only a single lifting post 18, lifting handle bar 20 and set of weight plates 3 will be described.

A locking cartridge 24 is located within the locking cartridge cavity 9 of the body 7 of each weight plate 3 so as to enable the weight plate to be selectively coupled to the lifting post 18 that is carried by the handle bar 20. The locking cartridge 24 is preferably removably received by the cavity 9 so that the cartridge 24 can be detached from the weight plate 3 for repair and/or replacement if necessary. To this end, the locking cartridge cavity 9 is provided with a generally V-shaped configuration within the body 7 of weight plate 3. The locking cartridge 24 has a matching V-shaped configuration to enable the receipt and alignment of locking cartridge 24 with locking cartridge cavity 9. A suitable fastener 25 may be inserted through the locking cartridge 24 to attach the cartridge to the weight plate 3 within the cartridge cavity 9 thereof.

The manner in which a weight plate 3 is detachably and selectively coupled to the lifting post 18 of the weight plate locking and lifting apparatus 1 by means of the locking cartridge 20 so that the weight plate can be lifted from its storage rack 5 is now described while continuing to refer to FIGS. 1-4 of the drawings. A weight plate with a detachable locking cartridge has been previously described in each of my patent application Ser. Nos. 12/217,743 filed Jul. 9, 2008 and 11/349,101 filed Feb. 8, 2006. The teachings of these copending applications are incorporated herein by reference.

The locking cartridge 24 includes a sliding locking pin 26 that is adapted to be displaced reciprocally through the locking channel 12 in body 7 of the weight plate 3 and into detachable coupling engagement with the weight plate lifting post 18 carried by the handle bar 20. More particularly, and without having to displace the rack 5 or first remove any of the weight plates 3 seated therein, the handle bar 20 is lowered towards the rack 5 (in the direction of the reference arrow of FIG. 1) until the lifting post 18 is seated within the lifting post cavity 10 of one weight plate 3 such that one of the series of coupling holes 22 through lifting post 18 is axially aligned with each of the locking channel 12 and locking channel extension 14. The particular one of the coupling holes 22 so aligned will depend upon the location of the weight plate 3 within the storage rack 5.

Figure 3:
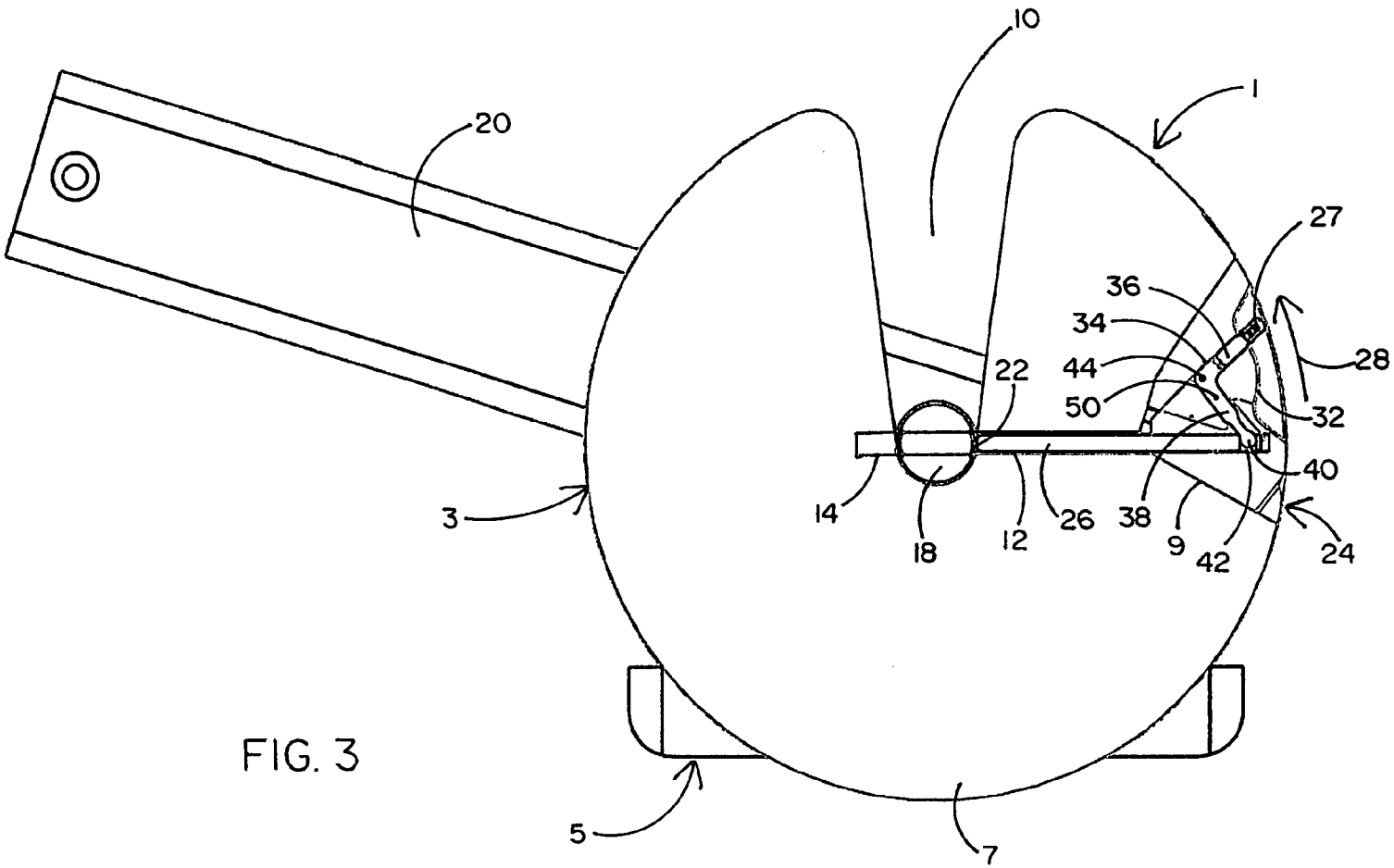
FIG. 3 shows a weight plate of the weight plate locking and lifting system of FIGS. 1 and 2 detached from a weight plate lifting post prior to or at the conclusion of a body building exercise.
Figure 4:
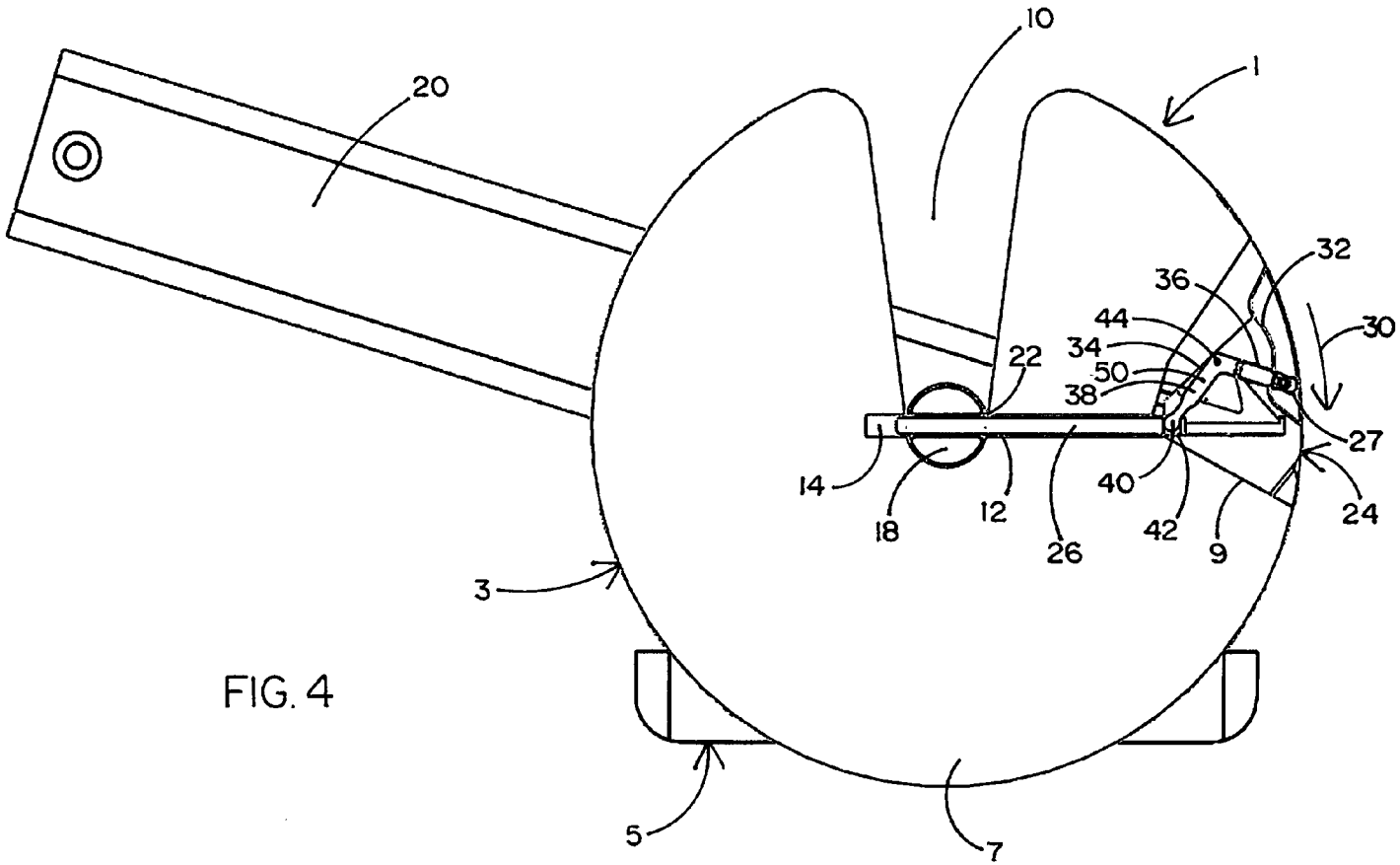
FIG. 4 shows the weight plate of FIG. 3 attached to the weight plate lifting post to be lifted out of the storage rack during the body building exercise.

The reciprocal displacement of the locking pin 26 of locking cartridge 24 through locking channel 12 is controlled by a switch knob 27 that is manually manipulated (i.e., rotated) back and forth between unlocked and locked positions in the directions of the reference arrows designated 28 and 30 in FIGS. 3 and 4. The switch knob 27 is moved through a guide slot 32 at the top of the locking cartridge 24. The switch knob 27 is interconnected with the locking pin 26 by way of a rotatable toggle lever switch arm 34 (best shown in FIGS. 3 and 4) that is located within the cartridge 24 so that a rotational force applied to the switch knob 27 is translated by switch arm 34 into a linear displacement of the locking pin 26 within the locking channel 12 through weight plate 3.

The rotatable toggle lever switch arm 34 includes an upper arm portion 36 and a lower arm portion 38 that are coextensively joined to one another at an elbow and aligned to make an angle of about 90 degrees. One end of the upper arm portion 36 of toggle lever switch arm 34 extends outwardly and through the guide slot 32 in the locking cartridge 24 to be attached to the switch knob 27. One end of the lower arm portion 38 of switch arm 34 includes a relatively wide switch head 40 that is located in and captured by a bore 42 formed near the outer end of the locking pin 26, whereby a rotation of the switch knob 27 (in one of the directions 28 or 30 of FIGS. 3 and 4) causes the switch head 40 to generate a pushing or pulling force for correspondingly causing the locking pin 26 to slide through the locking channel 12. A swage pin 44 or similar pivot is connected through the elbow at the intersection of the upper and lower arm portions 36 and 38 of the toggle lever switch arm 34 to establish a pivot axis around which switch arm 34 will rotate in response to a rotational force applied by the user to move the switch knob 27 to one of the unlocked or locked positions. A (e.g., coil) spring 50, or the like, is connected from the lower arm portion 38 of the toggle lever switch arm 34 to the locking cartridge 24 to urge the switch arm 34 to one of the locked or unlocked positions in order to avoid an indefinite intermediate position.

In operation, the switch knob 27 can be rotated by the user between the unlocked position of FIG. 3 (in the direction of reference arrow 28) and the locked position of FIG. 4 (in the direction of the reference arrow 30). As the switch knob 27 is rotated, the upper arm portion 36 of the toggle lever switch arm 34 is likewise rotated around the swage pin 44 so as to move through the guide slot 32 at the top of the locking cartridge 24. The lower arm portion 38 of switch arm 34 which is interconnected to the locking pin 26 by the receipt of switch head 40 within the bore 42 of pin 26 rotates with the upper arm portion 36 around the swage pin 44 so as to either push or pull the locking pin 26 through the locking channel 12 depending upon the direction in which the switch knob 27 is rotated.

In particular, when the switch knob 27 is rotated to the unlocked position of FIG. 3, the toggle lever switch arm 34 of locking cartridge 24 is likewise rotated around the swage pin 44, and the locking pin 26 is pulled in a first direction through the locking channel 12 of weight plate 3 by the switch head 40 of switch arm 34 so as to be withdrawn from a coupling hole 22 in the lifting post 18 and moved inwardly of cartridge 24. The weight plate 3 can now be returned to its slot 16 in the nearby storage rack 5 following an exercise. That is, the lifting post 18 is detached from the weight plate 3 so as to be lifted upwardly and out of the lifting post cavity 10 in response to an upward lifting force applied to the lifting handle bar 20.

In the case where the weight plate 3 is to be attached to the lifting post 18 so as to be lifted out of its slot 16 in the storage rack 5 alone or in combination with other weight plates, the lifting post 18 is lowered into and seated within the lifting post cavity 10, and the switch knob 27 is rotated to the locked position of FIG. 4 to cause the toggle lever switch arm 34 to likewise rotate around swage pin 44. The locking pin 26 is thusly pushed in an opposite direction outwardly from the locking cartridge 24 and through the locking channel 12 of weight plate 3 by the switch head 40 of switch arm 34. The locking pin 26 will then slide through the axially-aligned coupling hole 22 in the lifting post 18 for receipt by the locking channel extension 14, whereby the weight plate 3 is now coupled to the lifting post 18 to be lifted upwardly and out of storage rack 5 in response to an upward lifting force applied to the lifting handle bar 20.

It can be recognized that the toggle lever switch arm 36 that rotates within the locking cartridge 24 performs the function of a mechanical switch. That is to say, the switch knob 27 is rotated between the unlocked (off) and locked (on) positions of FIGS. 3 and 4 so that the sliding locking pin 26 of locking cartridge 24 is either withdrawn from a coupling hole 22 formed in the lifting post 18 to detach the weight plate 3 from the lifting post or received through a coupling hole 22 to attach the weight plate 3 to the lifting post 18.

Figure 5:
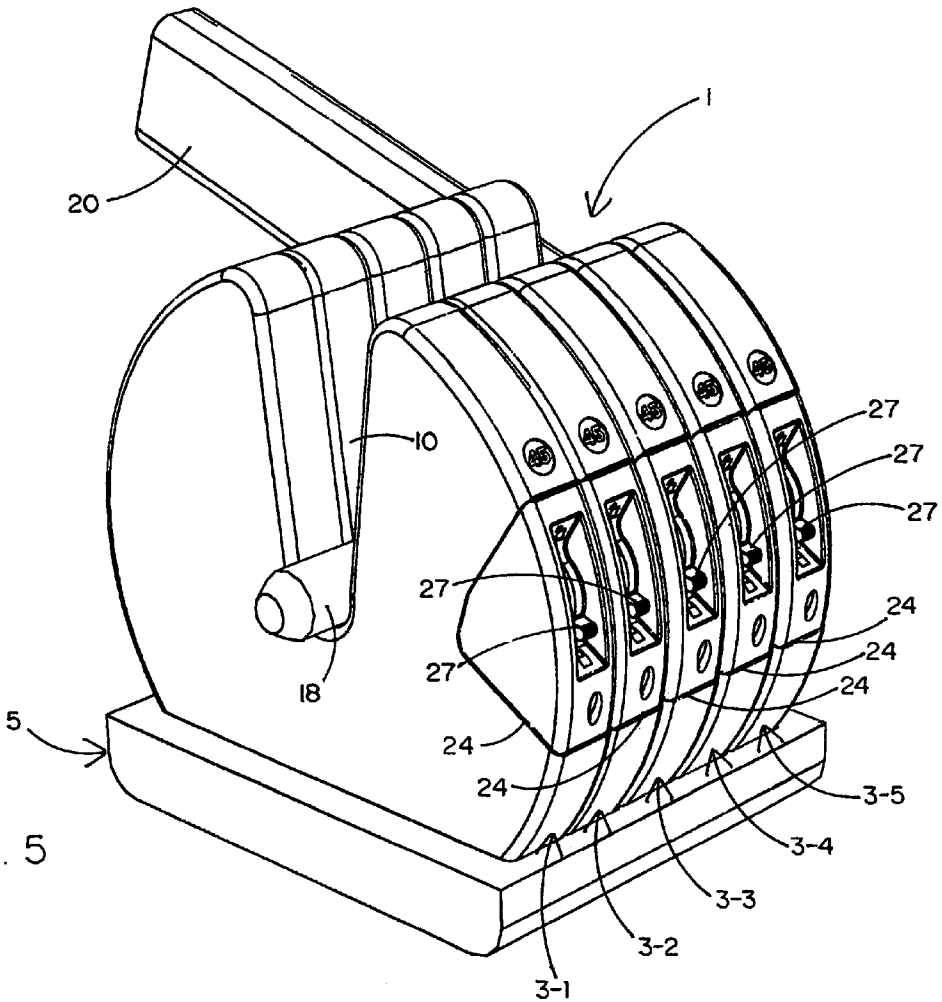
FIGS. 5 and 6 show a number of weight plates attached to the weight plate lifting post and ready to be lifted out of the storage rack.
Figure 6:
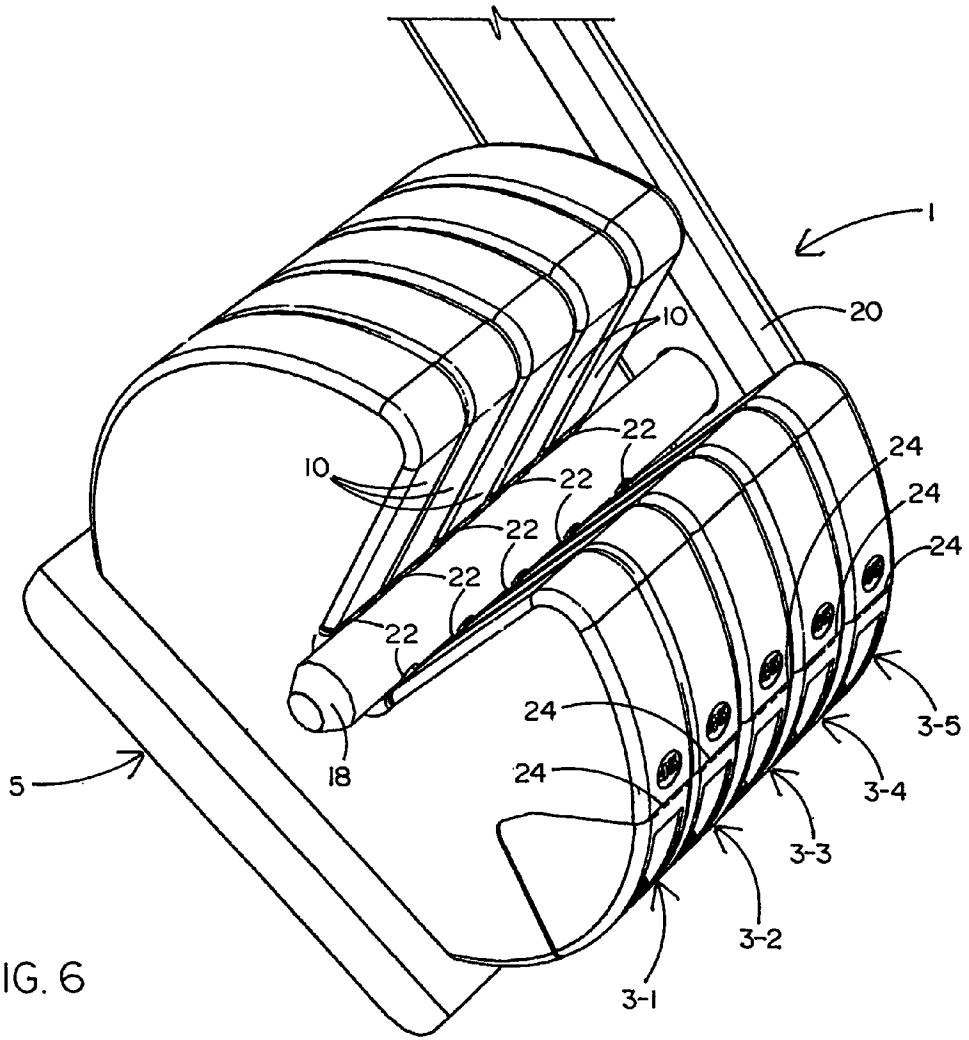

FIGS. 3 and 4 show a single weight plate 3, being detached from or coupled to the weight plate lifting post 18 carried by the lifting handle bar 20 to return the weight plate to or lift the weight plate from its slot 16 in the storage rack 5 depending upon the direction in which the switch knob 27 of the weight plate locking cartridge 24 is rotated. FIGS. 5 and 6 of the drawings show a number of weight plates 3-1, 3-2, 3-3, 3-4, and 3-5 ready to be detached from the lifting post 18 so as to be either returned to the rack 5 at the end of an exercise or attached to and lifted out of the rack 5 at the beginning of an exercise. As is best shown in FIG. 6, the lifting post cavities 10 of the weight plates 3-1 . . . 3-5 are all aligned end-to-end one another for the simultaneous receipt and accommodation of the lifting post 18 therewithin. In this case, the user selectively rotates the switch knob 27 of each of the weight plates 3-1 . . . 3-5 to one of the unlocked or locked positions by which to cause the respective locking pins (designated 26 in FIGS. 3 and 4) of the weight plate locking cartridges 24 to slide out of engagement with or into receipt by corresponding ones of the coupling holes 22 formed in the lifting post 18 in the manner previously described.

Figure 7:
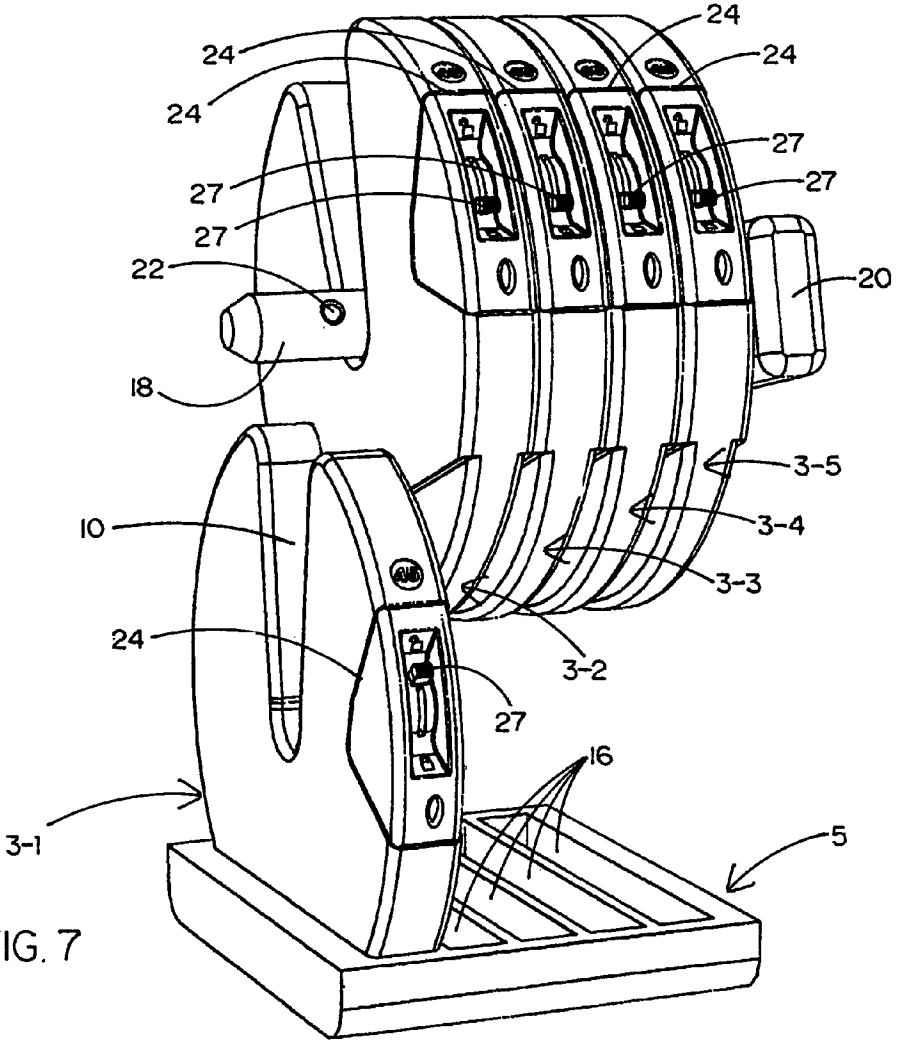
FIG. 7 shows a number of weight plates which are attached to the weight plate lifting post being lifted out of the storage rack and another weight plate which is detached from the lifting post remaining seated within the rack.

It may therefore be appreciated that any number of weight plates can be selectively coupled to (or removed from) the weight plate lifting post 18 to meet the weight lifting requirements of the exercise by the user simply rotating the switch knob 27 of the different weight plates to the locked or unlocked position. By virtue of the foregoing, the user need not lift, handle or transport any of the weight plates to or from the nearby storage rack 5 in which the weight plates are seated when not being used for an exercise. As represented by FIG. 7 of the drawings, only some of the available weight plates (e.g., 3-2, 3-3, 3-4 and 3-5) are coupled to the lifting post 18 to be removed from the rack 5 during an exercise while other weight plates (e.g., 3-1) can remain uncoupled and left behind within the rack 5.

FIGS. 1-7 of the drawings show a weight plate locking and lifting system 1 including a plurality of weight plates 3, each having a lifting post cavity 10 formed therein to receive a weight plate lifting post 18 that is carried by and extends from a lifting handle bar 20. A sliding locking pin 26 from a detachable locking cartridge 24 of a weight plate 3 rides through one of a series of coupling holes 22 formed in the lifting post 18 by which to couple the weight plate 3 to the lifting post so that a lifting force can be applied to the lifting handle bar 20 by which to lift the weight plate from a storage rack 5. The teachings and advantages of this embodiment are also applicable to a dumbbell or a bar bell to which a number of weight plates are removably attached.

Figure 8:
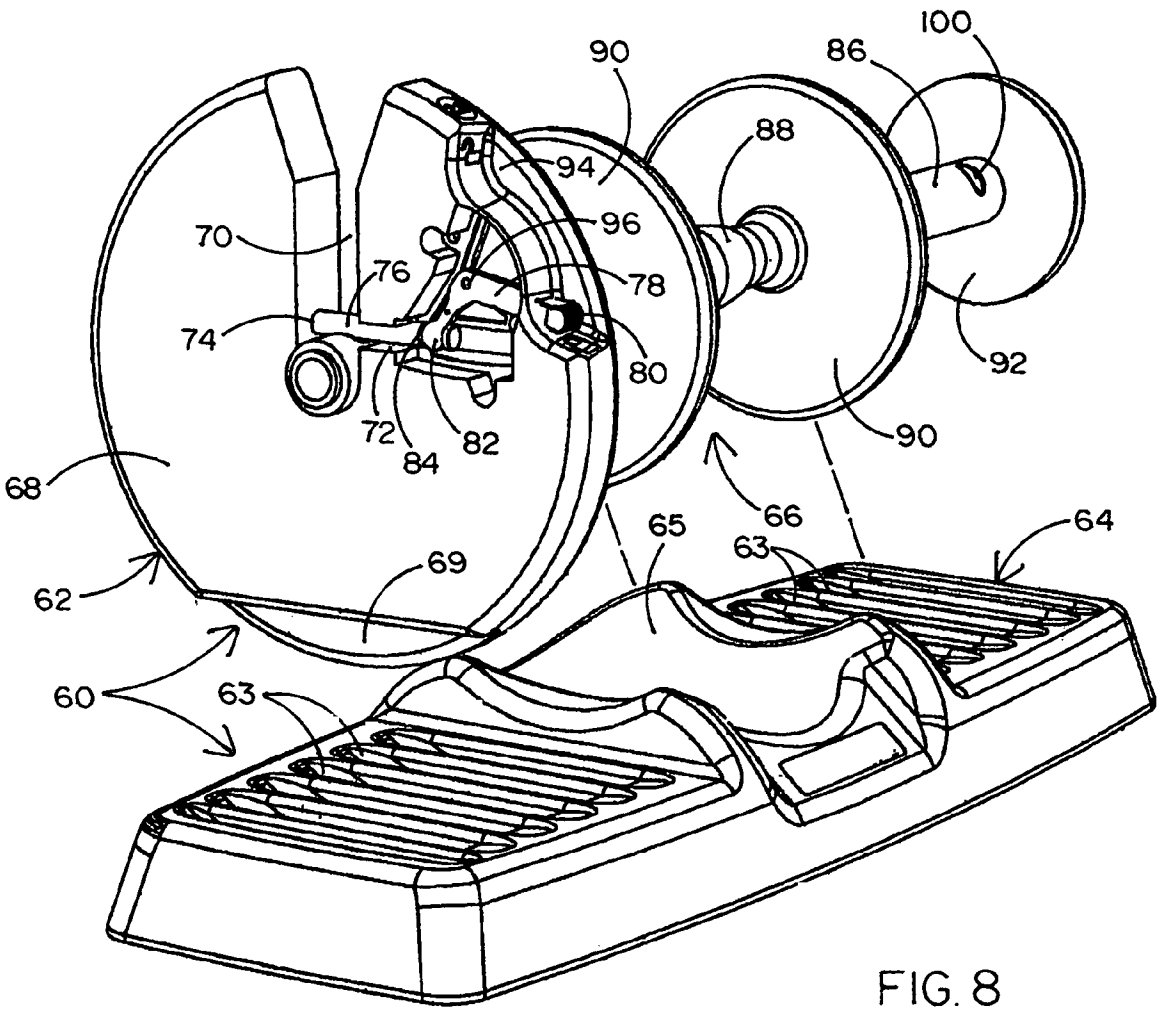
FIGS. 8 and 9 shows a weight plate locking and lifting system (e.g., a dumbbell) according to another preferred embodiment of this invention by which one or more weight plates are lifted outwardly from or returned to a storage rack.
Figure 9:
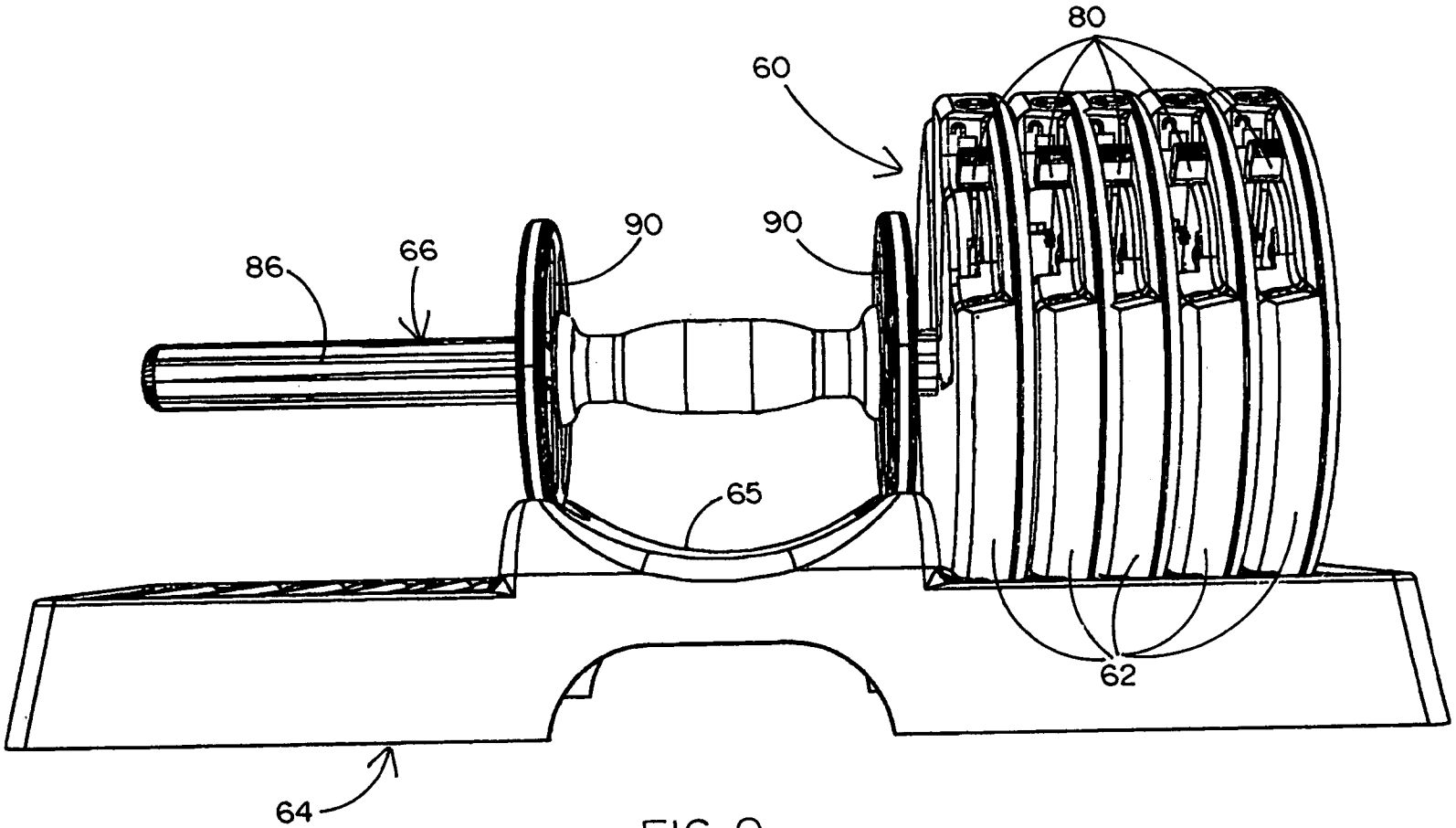

Referring in this regard to FIGS. 8 and 9 of the drawings, a weight plate locking and lifting system 60 according to another preferred embodiment is shown which enables a desired number of individual weight plates 62 that are seated within slots 63 of a nearby storage rack 64 to be engaged and lifted from the rack to form a dumbbell 66 (or a bar bell). By virtue of the foregoing, an individual will be able to lift the weight plates 62 without having to first remove, handle and carry the weight plates from a remote location. As in the weight plates 3 of the earlier disclosed weight plate locking and lifting system 1, each weight plate 62 of the locking and lifting system 60 of FIGS. 8 and 9 has a disk-like body 68. The body 68 has an area of reduced thickness formed along the bottom thereof to create a lipped projection 69 (of FIG. 8) for receipt within a slot 63 of storage rack 64 to stabilize the weight plate 62 seated in the rack. A radially-extending lifting bar cavity 70 is formed through the body 68 from the top edge thereof. The lifting bar cavity 70 is located between an axially-aligned locking channel 72 and a locking channel extension 74 which run through body 68.

Each weight plate 62 of the dumbbell 66 has a locking pin 76 that is slidable reciprocally through the axially-aligned locking channel 72 and the locking channel extension 74 as well as the lifting bar cavity 70 located therebetween in response to a pushing force applied to a switch knob 80 at one end of a toggle lever switch arm 78. A relatively wide switch head 82 at the opposite end of the switch arm 78 is received within a bore 84 that is formed in the sliding locking pin 76. In the locking and lifting system 1 of FIGS. 1-7, a locking pin and a toggle lever switch arm are housed within a locking cartridge 24 that is detachably connected to a weight plate. However, for the weight plate 62 of FIGS. 8 and 9, the locking pin 76 and the toggle lever switch arm 78 are built into and made an integral part of the weight plate, such that no separate locking cartridge is present.

The manner in which a weight plate 62 is removably attached to the dumbbell 66 is now described. Dumbbell 66 includes a handle bar 86 with a hand gripping surface 88 located between a pair of inside collars 90. A pair of outside end caps 92 (only one of which being shown in FIG. 8) are separated from the inside collars 90 at opposite ends of the handle bar 86. A particular number of weight plates 62 corresponding to a desired cumulative weight to be lifted is coupled to the handle bar 86 between an opposing inside collar 90 and an outside end cap 92. Without having to displace the rack 64 or pull out any of the weight plates seated therein, the handle bar 86 is lowered such that the inside collars 90 of the dumbbell 66 are seated upon a raised cradle 65 of rack 64 (best shown in FIG. 9). The handle bar 86 of dumbbell 66 is moved downwardly through the lifting bar cavities 70 of the weight plates 60 seated in the storage rack 64.

The switch knob 80 of the toggle lever switch arm 78 is moved (i.e., rotated) from an unlocked position to a locked position through a guide slot 94 formed in an outer edge of the weight plate 68 to be attached to the dumbbell 66. A movement of the switch knob 80 causes a rotation of the toggle lever switch arm 78 around a pivot pin 96 and a corresponding linear displacement of the locking pin 76. As is best shown in FIG. 8, when the switch knob 80 is moved to the locked position, a pushing force is applied to the locking pin 76 by the switch arm 78 at the switch head 82. Accordingly, the locking pin 76 is caused to slide through each of the locking channel 72, the lifting bar cavity 70, and the locking channel extension 74.

The locking pin 76 rides through the lifting bar cavity 70 to lie over top and against the handle bar 86 received therein. The engagement of the handle bar 86 by the locking pin 76 couples the weight plate 68 to the handle bar to prevent an inadvertent separation when the dumbbell 66 is lifted off the storage rack 64. A coupling slot 100 (best shown in FIG. 8) is formed in the top of handle bar 86 to receive and positively locate the locking pin 76 sliding thereover.

When it is desirable to detach a weight plate 62 from the handle bar 86 of dumbbell 66 to be returned to the storage rack 64, the switch knob 80 is moved (i.e., rotated) to an unlocked position (not shown), whereby the toggle lever switch arm 78 applies a pulling force to the locking pin 76. Accordingly, the locking pin 76 will be withdrawn from the locking channel extension 74 and the lifting bar cavity 70 of the weight plate 62 so that the handle bar 86 of dumbbell 62 can now be lifted upwardly and out of the lifting bar cavity 70.

The invention claimed is:

1. Physical fitness weight lifting apparatus, comprising:

first and second weight plates, each weight plate having a lifting opening formed therein and a locking channel running therethrough and communicating with said lifting opening, said first and second weight plates being aligned side-by-side one another so that the respective lifting openings thereof are aligned in order to communicate with one another and thereby establish a lifting channel that runs continuously and uninterruptedly through said first and second weight plates;

a weight plate lifting element having first and second weight plate coupling holes formed therethrough, said weight plate lifting element being removably received within the lifting channel that runs continuously and uninterruptedly through said first and second weight plates;

a locking cartridge carried by each of said first and second weight plates, each locking cartridge having a locking pin slidable reciprocally through the locking channel of a respective one of said first and second weight plates relative to one of the first and second weight plate coupling holes of said weight plate lifting element received within said lifting channel, said locking cartridge also having a switch arm interconnected with said locking pin and moving to a locked on position for causing said locking pin to slide in a first direction through said locking channel and into receipt by the one of said first and second weight plate coupling holes of said weight plate lifting element by which to attach said respective weight plate to said weight plate lifting element, and said switch arm moving to an unlocked off position for causing said locking pin to slide in a second opposite direction through said locking channel and out of receipt by the one weight plate coupling hole of said weight plate lifting element by which to detach said respective weight plate from said weight plate lifting element; and the lifting opening formed in each of said first and second weight plates to establish said lifting channel for the removable receipt of said weight plate lifting element is a cavity extending from an outside edge of each weight plate to allow said weight plate lifting element to removably pivot in and out of said cavity.

2. The physical fitness weight lifting apparatus recited in claim 1, wherein each of said first and second weight plates has a disk body, the lifting opening formed in each weight plate to establish said lifting channel for the removable receipt of said weight plate lifting element is a cavity extending radially through said disk body from an outside edge thereof.

3. The physical fitness weight lifting apparatus recited in claim 1, wherein each of said first and second weight plates also has a locking cartridge cavity formed therein at which to receive said locking cartridge, the locking channel running through each weight plate extending between said locking cartridge cavity thereof and the lifting opening formed therein.

4. The physical fitness weight lifting apparatus recited in claim 1, further comprising a handle bar coupled to said weight plate lifting element, a lifting force applied to said handle bar being transmitted to at least one of said first and second weight plates by way of said weight plate lifting element for lifting said at least one weight plate when the switch arm of said locking cartridge of said at least one weight plate is moved to the locked on position so that said locking pin slides in said first direction and said at least one weight plate is attached to said weight plate lifting element.

5. The physical fitness weight lifting apparatus recited in claim 4, further comprising a storage rack within which said first and second weight plates are seated, said at least one weight plate being lifted out of said storage rack when said lifting force is applied to said handle bar coupled to said weight plate lifting element, and said at least one weight plate being returned to said storage rack when a lowering force is applied to said handle bar and the switch arm of said locking cartridge of said at least one weight plate is moved to the unlocked off position so that the locking pin slides in said opposite direction and said at least one weight plate is detached from said weight plate lifting element.

6. The physical fitness weight lifting apparatus recited in claim 1, wherein the switch arm of said locking cartridge of each of said first and second weight plates is rotatable between said locked on and unlocked off positions.

7. The physical fitness weight lifting apparatus recited in claim 6, wherein said switch arm of the locking cartridge of each of said first and second weight plates has first and second arm portions, said first arm portion being manually accessible to receive a rotational force to cause said switch arm to rotate within said locking cartridge between said locked on and unlocked off positions, and said second arm portion being coupled to said locking pin such that a rotation of said switch arm causes said locking pin to correspondingly slide in one of said first or second directions through said locking channel.

8. The physical fitness weight lifting apparatus recited in claim 7, wherein said locking pin of the locking cartridge of each of said first and second weight plates has a bore formed therein, the second arm portion of said switch arm being coupled to said locking pin within said bore.

9. The physical fitness weight lifting apparatus recited in claim 8, wherein the second arm portion of said switch arm of the locking cartridge of each of said first and second weight plates includes a coupling head received within the bore of said locking pin by which said second arm portion is coupled to said locking pin.

10. The physical fitness weight lifting apparatus recited in claim 1, wherein each of the lifting openings formed in said first and second weight plates to establish said lifting channel for the receipt of said weight plate lifting element is said cavity extending from said outside edge of each of said first and second weight plates, the cavities of said first and second weight plates being aligned end-to-end one another.

11. Physical fitness weight lifting apparatus, comprising:

a plurality of weight plates, each having a lifting opening formed therein and each having a locking channel running therethrough and communicating with said lifting opening, the lifting opening of each weight plate extending from a point located at an outside edge of said weight plate to a point located at the interior of said weight plate inwardly of said outer edge, said plurality of weight plates being aligned side-by-side one another such that the lifting openings of said weight plates are aligned to communicate with one another and thereby establish a lifting channel that runs continuously and uninterruptedly through said plurality of weight plates;

a weight plate lifting element having a plurality of weight plate coupling holes formed therethrough, said weight plate lifting element being pivotably removably received within the lifting channel which runs continuously and interruptedly through said plurality of weight plates; and a locking cartridge carried by each of said plurality of weight plates, each locking cartridge having a locking pin slidable reciprocally through the locking channel of each weight plate relative to the plurality of weight plate coupling holes of said weight plate lifting element received within the lifting channel through said plurality of weight plates, each locking cartridge also having a switch arm interconnected with said locking pin and moving to a locked on position for causing the locking pin to slide in a first direction through said locking channel and into receipt by a respective one of said plurality of weight plate coupling holes of said weight plate lifting element by which to attach said weight plate to said weight plate lifting element, and said switch arm moving to an unlocked off position for causing said locking pin to slide in a second opposite direction through said locking channel and out of receipt of said one weight plate coupling hole of said weight plate lifting element by which to detach said weight plate from said weight plate lifting element, the locking pins of the locking cartridges of said plurality of weight plates sliding independently of one another into and out of receipt of the respective weight plate coupling holes of said lifting element depending upon the positions to which the switch arms of said locking cartridges are moved.

12. The physical fitness weight lifting apparatus recited in claim 11, wherein each of said plurality of weight plates has a disk body, and the lifting opening formed in each weight plate for receipt of said weight plate lifting element is a cavity extending radially through said disk body from the point at said outside edge thereof, the cavities of said weight plates being aligned end-to-end one another to form said lifting channel through said weight plates.

13. The physical fitness weight lifting apparatus recited in claim 11, wherein each of said plurality of weight plates also has a locking cartridge cavity formed therein at which to receive said locking cartridge, the locking channel running through each weight plate extending between said locking cartridge cavity thereof and the lifting opening formed therein.

14. The physical fitness weight lifting apparatus recited in claim 11, further comprising a handle bar coupled to said weight plate lifting element, a lifting force applied to said handle bar being transmitted to said plurality of weight plates by way of said weight plate lifting element for lifting selected ones of said weight plates when the switch arms of the locking cartridges of said selected weight plates are moved to the locked on position so that said selected weight plates are attached to said weight plate lifting element.

15. The physical fitness weight lifting apparatus recited in claim 14, further comprising a storage rack within which said plurality of weight plates are seated, the selected ones of said weight plates being lifted out of said storage rack when the lifting force is applied to said handle bar coupled to said weight lifting element and when the switch arms of the locking cartridges of the selected weight plates are moved to the locked on position, and said selected weight plates being returned to said storage rack when a lowering force is applied to said handle bar and when the switch arms of the locking cartridges of the selected weight plates are moved to the unlocked off position.

16. The physical fitness weight lifting apparatus recited in claim 11, wherein the switch arms of the locking cartridges of said plurality of weight plates are rotatable between said locked on and unlocked off positions, said switch arms being interconnected to respective ones of said locking pins such that a rotation of a particular switch arm from a particular weight plate causes said locking pin of the locking cartridge thereof to slide in one of said first or second directions through the locking channel of said particular weight plate.

17. The physical fitness weight lifting apparatus recited in claim 11, wherein each of the locking pins of the locking cartridges of said plurality of weight plates has a bore formed therein, said switch arms being interconnected to respective ones of said locking pins within said bores thereof.

18. Physical fitness weight lifting apparatus, comprising:

at least one weight plate having a disk body, said disk body including an outer peripheral edge, a pair of opposing sides surrounded by said outer peripheral edge, a lifting opening extending in a radial direction from said outer peripheral edge and running continuously and uninterruptedly through said disk body between said opposing sides thereof in a direction that is perpendicular to said radial direction, and a locking channel communicating with said lifting opening;

a weight plate lifting element to which said at least one weight plate is to be detachably connected, said weight plate lifting element being removably received within the lifting opening of said weight plate so as to extend in said perpendicular direction and run completely through said disk body between said opposing sides thereof;

a locking pin slidable reciprocally through the locking channel of said weight plate; and a switch arm interconnected with said locking pin and moving to a locked position for causing said locking pin to slide in a first direction inwardly through said locking channel and into engagement with said weight plate lifting element within said lifting opening by which to attach said weight plate to said lifting element, and said switch arm moving to an unlocked position for causing said locking pin to slide in an opposite direction outwardly from said locking channel and out of engagement with said weight plate lifting element by which to detach said weight plate from said lifting element.

19. The physical fitness weight lifting apparatus recited in claim 18, further comprising a storage rack within which said at least one weight plate is seated, said weight plate lifting element sliding through and into said removable receipt by said lifting opening while said weight plate is seated within said storage rack.

20. The physical fitness weight lifting apparatus recited in claim 18, wherein said locking pin moves over the top of and into engagement with said weight plate lifting element so as to prevent a removal of said lifting element from said lifting opening and a detachment of said weight plate from said lifting element when said switch arm moves to the locked position and said locking pin slides in the first direction.

21. The physical fitness weight lifting apparatus recited in claim 18, wherein said at least one weight plate is attached to said weight plate lifting element to form a dumbbell.

* * * * *